US005322180A

United States Patent [19]

Ker

[11] Patent Number: 5,322,180

[45] Date of Patent: Jun. 21, 1994

[54] GARBAGE CAN

[76] Inventor: Tsung Ei Ker, P.O. Box 1750, Taichung, Taiwan

[21] Appl. No.: 155,713

[22] Filed: Nov. 22, 1993

[51] Int. Cl.[5] ..... B65D 85/00

[52] U.S. Cl. ..... 220/407; 220/908

[58] Field of Search ..... 220/407, 908

[56] References Cited

U.S. PATENT DOCUMENTS

| | | | |
|---|---|---|---|
| 3,300,082 | 1/1967 | Patterson | 220/407 |
| 3,392,825 | 7/1968 | Gale et al. | 220/407 |
| 3,451,453 | 6/1969 | Heck | 220/407 |
| 3,760,976 | 9/1973 | Nilsson | 220/407 |
| 3,800,503 | 4/1974 | Maki | 220/407 |
| 4,823,979 | 4/1989 | Clark, Jr. | 220/407 |
| 4,850,507 | 7/1989 | Lemongelli et al. | 220/407 |
| 4,850,508 | 7/1989 | Lee | 220/407 |
| 4,955,505 | 9/1990 | Battaglia | 220/407 |

FOREIGN PATENT DOCUMENTS

| | | | |
|---|---|---|---|
| 2253989 | 9/1992 | United Kingdom | 220/407 |

*Primary Examiner*—Joseph Man-Fu Moy

[57] ABSTRACT

A garbage can comprises a bottom provided on the upper side thereof with a bottom seat made up of a receiving slot dimensioned to house an entire roll of garbage bags, two side plates having respectively an arcuate upper edge, a cover fastened pivotally to the two side plates, and a front plate. When the receiving slot is covered in full with the cover, there is a gap formed between the upper edge of the front plate and the cover. The dimension of the gap is such that the garbage bags can be easily pulled out of the receiving slot via the gap. The new garbage bags kept in the receiving slot are shielded by the cover, the front plate and the two side plates so that the new garbage bags can not be soiled by the garbage liquid seeping out through a cut or leak in the garbage bag containing the garbage.

2 Claims, 3 Drawing Sheets

GARBAGE CAN

FIELD OF THE INVENTION

The present invention relates generally to a garbage can, and more particularly to a garbage can provided with means capable of facilitating the replenishing of the garbage can with a new garbage bag, and of preventing the garbage can from being soiled by the garbage liquid.

BACKGROUND OF THE INVENTION

A garbage can is a household item that is used very frequently. In order to facilitate the disposal of the household wastes, the inside wall of the garbage can is generally lined with a garbage bag in which the wastes are kept. However, the garbage can has to be lined again with a new garbage bag each time when the full garbage bag is disposed of. Such a household chore of lining the garbage can with the garbage bag is not something that people enjoy doing. As a result, a new kind of garbage can was introduced. Such garbage can is provided at the bottom thereof with means in which a stack of new garbage bags are kept in such a manner that a new garbage bag can be pulled out through an opening. Nevertheless people are often annoyed at the fact that the new garbage bag can not be easily pulled out via the opening and that the new garbage bags kept at the bottom of the garbage can are often soiled by the garbage liquid seeping out of the garbage bag through a leak in the garbage bag.

SUMMARY OF THE INVENTION

It is, therefore, the primary objective of the present invention to provide an improved garbage can capable of overcoming the shortcomings of the prior art garbage can described above.

In keeping with the principle of the present invention, the foregoing objective of the present invention is attained by an improved garbage can, which comprises a bottom provided on the upper side thereof with a bottom seat of rectangular construction. The bottom seat is composed of a receiving slot dimensioned to house therein an entire roll of garbage bags, two side plates having respectively an arcuate upper edge, a cover fastened pivotally to the two side plates, and a front plate. When the receiving slot of the bottom seat is covered with the cover, there is a gap formed between the upper edge of the front plate and the cover. The dimension of the gap is such that the garbage bag can be easily pulled out of the receiving slot via the gap. In addition, the new garbage bags kept in the receiving slot are shielded by the cover so that they can not be soiled by the garbage liquid that may seep out accidentally through a cut or leak in the garbage bag which contains the garbage and is kept in the garbage can.

The foregoing objective and features of the present invention can be more readily understood upon a thoughtful deliberation of the following detailed description of a preferred embodiment of the present invention in conjunction with the drawings provided herewith.

DETAILED DESCRIPTION OF THE INVENTION

Figure 1:
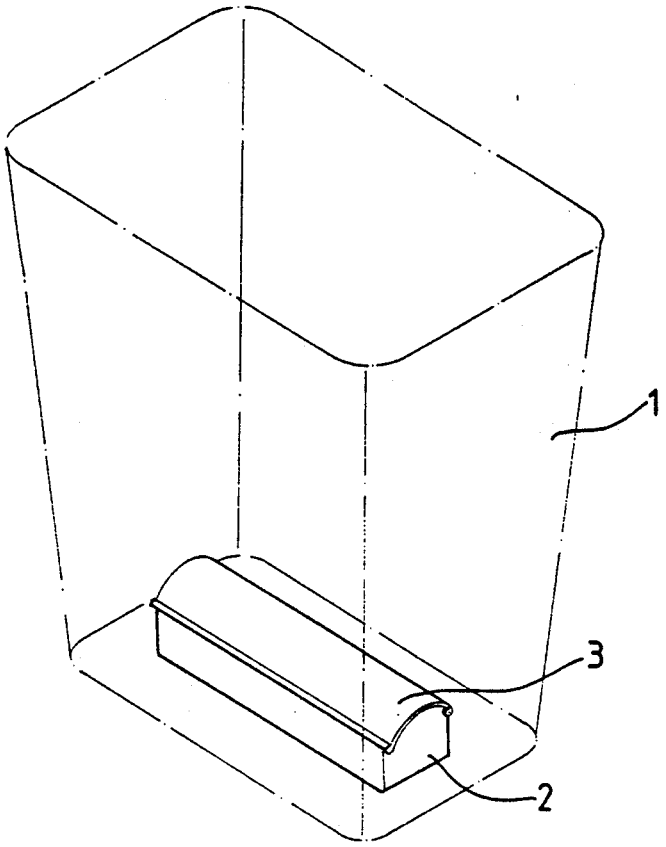
FIG. 1 shows a perspective view of the present invention.
Figure 2:
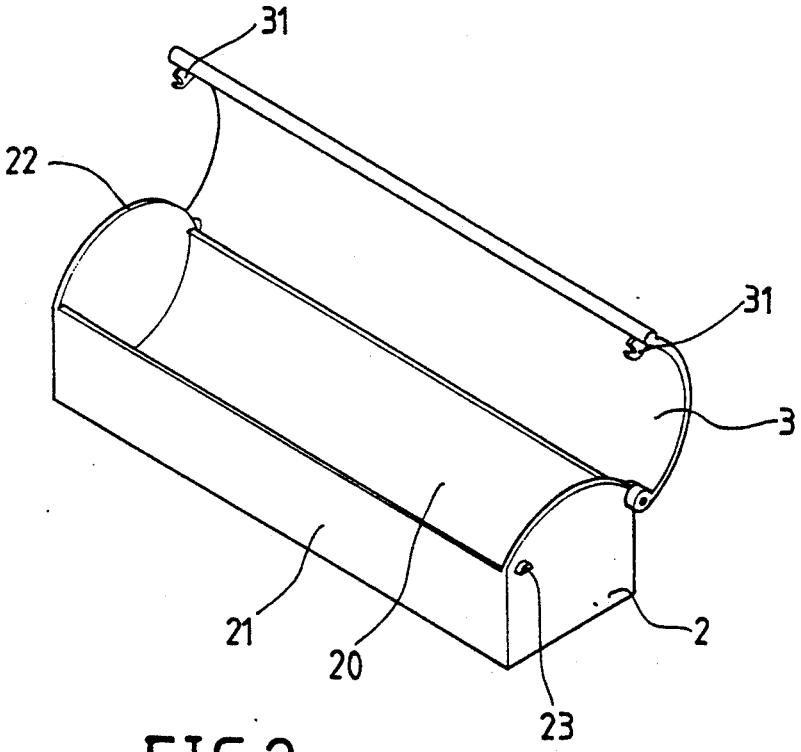
FIG. 2 shows a perspective view of the bottom seat of the present invention, with the bottom seat being uncovered.
Figure 3:
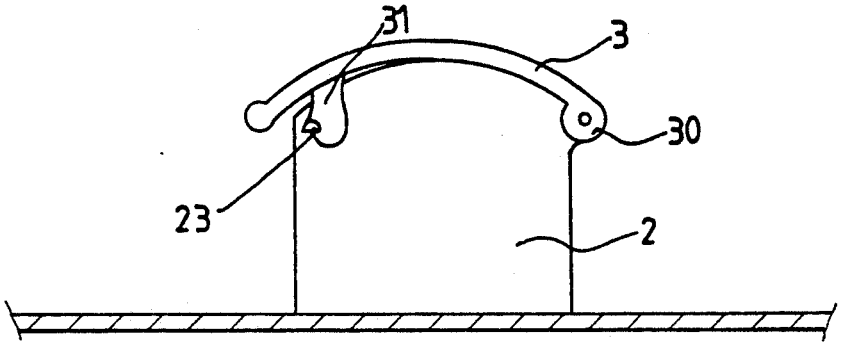
FIG. 3 shows a side elevational view of the bottom seat of the present invention.
Figure 4:
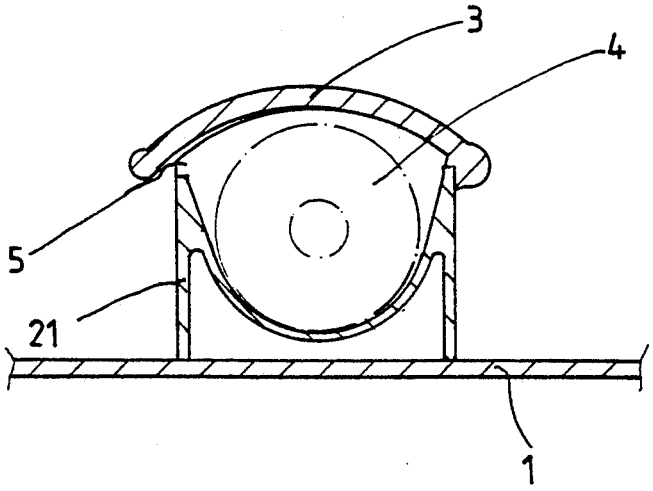
FIG. 4 shows a cross sectional view of the bottom seat of the present invention.
Figure 5:
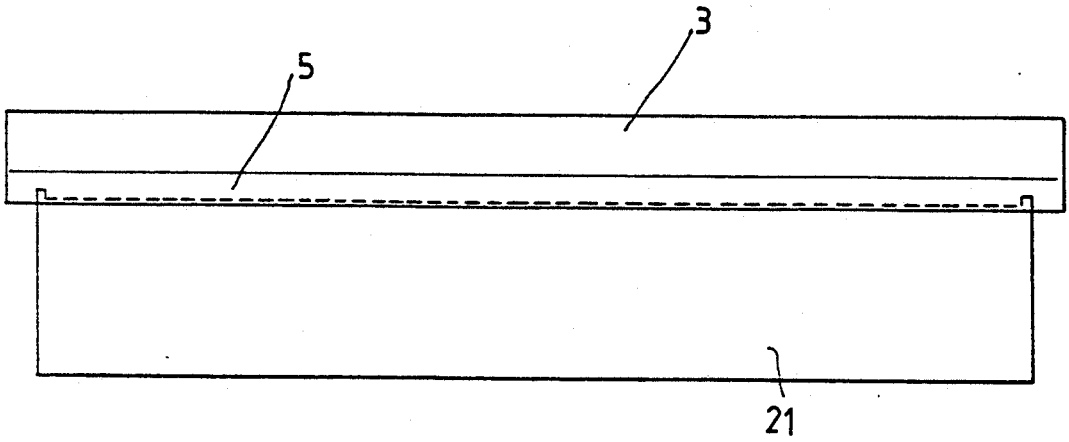
FIG. 5 shows a front elevational view of the bottom seat of the present invention.
Figure 6:
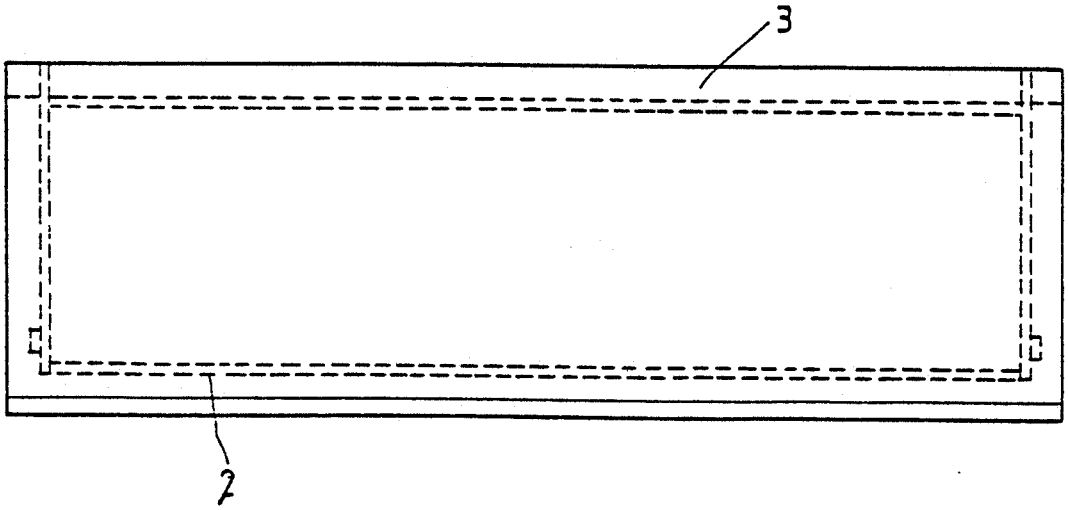
FIG. 6 shows a top plan view of the bottom seat of the present invention.

Referring to all drawings provided herein, a garbage can 1 embodied in the present invention is shown to comprise a bottom seat 2 mounted on the upper side surface of the bottom of the garbage can 1. The bottom seat 2 of rectangular construction is composed of two side plates 22, a front plate 21, a receiving slot 20 dimensioned to house therein a roll of garbage bags 4, and a cover 3 fastened pivotally to the two side plates 22 by two pivots 30 fastened to the two side plates 22, each of which has an arcuate upper edge and is taller than the front plate 21. As a result, there is a gap 5 formed between the cover 3 and the upper edge of the front plate 21 when the receiving slot 20 is covered entirely with the cover 3. The gap 5 is so dimensioned as to permit the garbage bags 4 in the receiving slot 20 to be pulled out easily by hand.

The cover 3 of arcuate construction having a curvature greater than that of the side plates 22 is provided with two retaining hooks 32 opposite in location to the two pivots 30. The two side plates 22 are provided respectively on the outer side surface thereof with a retainer 23 engageable securely with the retaining hook 32 of the cover 3 at such time when the receiving slot 20 is covered in full with the cover 3 having a width and a length, which are slightly greater than those of the bottom seat 2.

In replenishing the receiving slot 20 with a new roll of garbage bags 4, the receiving slot 20 is first uncovered by pressing with fingers the cover 3 so as to cause the retaining hooks 32 of the cover 3 to disengage the retainers 23 of the two side plates 22. Upon positioning properly the new roll of the garbage bags 4 in the receiving slot 20, the edge of the first garbage bag is so positioned as to emerge from the gap 5 before the receiving slot 20 is covered again with the cover 3. It must be noted here that the retaining hooks 32 of the cover 3 can be caused easily to disengage the retainers 23 of the two side plates 22 by pressing the cover 3 with fingers, in view of the fact that the cover 3 has a curvature greater than that of the top edge of the two side plates 22. The garbage bags 4 kept in the receiving slot 20 are well shielded by the front plate 21, two side plates 22, and the cover 3. As a result, the garbage bags 4 are immune from the likelihood of being soiled by the waste liquid seeping through a cut or leak in the garbage bag containing the garbage. It is also equally impossible that the new garbage bags 4 kept in the receiving slot 20 can be soiled by the waste liquid deposited at the bottom of the garbage can 1 as long as the level of the deposited waste liquid does not exceed the height of the front plate 21.

The embodiment of the present invention described above is to be regarded in all respects as merely illustrative and not restrictive. Accordingly, the present invention may be embodied in other specific froms without deviating from the spirit thereof. The present invention is therefore to be limited only by the scope of the following appended claims.

What is claimed is:

1. An improved garbage can comprising a container of a predetermined dimension and having a bottom provided onto an upper surface thereof with a bottom seat made up of a cover, a front plate, two side plates, and a receiving slot formed and defined by said front plate and said two side plates for accommodating therein a roll of garbage bags; wherein said cover has a predetermined width greater than that of said two side plates and a predetermined length greater than that of said front plate; and wherein said two said plates have respectively and arcuate top edge and a height greater than a height of said front plate so that a gap of a predetermined dimension is formed between a top edge of said front plate and said cover at the time when said receiving slot is covered in full with said cover, said gap being intended for use in pulling out by hand said garbage bags kept in said receiving slot.

2. The improved garbage can in accordance with claim 1 wherein said cover has an arcuate cross section with a curvature greater than a curvature of said arcuate top edge of each of said two side plates, said cover being fastened pivotally at both ends of one long side thereof to said two side plates by two pivots fastened respectively to said two side plates, said cover being provided respectively at both ends of another long side thereof with a retaining hook; and wherein said two side plates are provided respectively on an outer surface thereof with a retaining means engageable securely with said retaining hook at the time when said receiving slot is covered in full with said cover.

* * * * *